US005307950A

United States Patent [19]

Li

[11] Patent Number: 5,307,950

[45] Date of Patent: May 3, 1994

[54] CONTAINER FOR LIQUIDS

[76] Inventor: Hongbiao Li, 401 S. Sherman #305, Richardson, Tex. 75083-1389

[21] Appl. No.: 37,325

[22] Filed: Mar. 26, 1993

Related U.S. Application Data

[63] Continuation-in-part of Ser. No. 592,975, Oct. 2, 1990.

[51] Int. Cl.[5] ..... A47G 19/22

[52] U.S. Cl. ..... 220/714; 220/264; 220/705; 220/710.5; 215/2

[58] Field of Search ..... 220/264, 317, 318, 703, 220/705, 707, 709, 710.5, 711, 714, 715, 254; 215/2; 222/131, 146.6, 470, 471, 484, 526, 538, 469

[56] References Cited

U.S. PATENT DOCUMENTS

| | | | |
|---|---|---|---|
| 1,935,969 | 11/1933 | Witherspoon . | |
| 2,574,338 | 11/1951 | Lewis . | |
| 2,624,493 | 1/1953 | Porter | 222/469 |
| 2,721,672 | 10/1955 | Fahle . | |
| 2,884,157 | 4/1959 | Lampkin . | |
| 2,914,214 | 11/1959 | Messinger . | |
| 3,172,561 | 3/1965 | Schwartz . | |
| 3,511,407 | 5/1970 | Palma | 220/209 |
| 3,635,380 | 1/1972 | Fitzgerald . | |
| 3,776,458 | 12/1973 | Chunga, Sr. . | |
| 3,847,311 | 11/1974 | Flores et al. . | |
| 3,967,748 | 7/1976 | Albert . | |
| 3,980,210 | 9/1976 | Kligerman . | |
| 4,099,642 | 7/1978 | Nergard . | |
| 4,165,013 | 8/1979 | Lutz | 220/215 |
| 4,212,408 | 7/1980 | Valenzona . | |
| 4,276,992 | 7/1981 | Susich | 220/254 |
| 4,303,173 | 12/1981 | Nergard | 220/254 |
| 4,388,997 | 6/1983 | Grime | 220/209 |
| 4,494,668 | 1/1985 | Lottick . | |
| 4,596,341 | 6/1986 | Bruffey . | |
| 4,607,755 | 8/1986 | Andreozzi . | |
| 4,615,457 | 10/1986 | Harding . | |
| 4,750,644 | 6/1988 | Kolody . | |
| 4,982,854 | 1/1991 | Ichimiya . | |
| 5,005,717 | 4/1991 | Oilar . | |
| 5,048,705 | 9/1991 | Lynd et al. | 215/1 A |
| 5,135,128 | 8/1992 | Kuhn | 220/318 |
| 5,169,016 | 12/1992 | Hinz, Jr. | 220/254 |
| 5,222,623 | 6/1993 | Eger et al. | 220/715 |

*Primary Examiner*—Allan N. Shoap
*Assistant Examiner*—Stephen Cronin
*Attorney, Agent, or Firm*—Timmons & Kelly

[57] ABSTRACT

A pair of openings in the top of a container for liquids are normally closed by a pair of stoppers. The stoppers are mounted on the arms of a Y-shaped spring. The leg of the spring extends through a hole in the side of the container. The leg is connected to the upper end of a handle, which is connected to the container so that the handle pivots about the lower end of the handle. As the handle is pivoted, the leg of the spring is pulled outward through the hole in the side of the container. As the leg is pulled, the arms of the spring are pulled through a restraint, which pushes the arms together. This action pulls the stoppers away from the openings in the top of the container. The container also has a straw and a one-way valve. The valve allows air to enter the container, but does not allow liquid to spill from the container.

10 Claims, 3 Drawing Sheets

CONTAINER FOR LIQUIDS

CROSS-REFERENCE TO RELATED APPLICATION

This is a continuation-in-part of application Ser. No. 07/592,975, filed Oct. 2, 1990.

BACKGROUND OF THE INVENTION

1. Field of the Invention

This invention relates in general to containers for liquids. In particular, the invention relates to drinking containers designed not to spill when capsized.

2. Description of the Prior Art

Various types of drinking containers have been designed not to spill when capsized. Most of these non-spill containers have a lid, and a covered hole. In most cases, the hole must be manually uncovered before the liquid in the container can be poured out of the container.

In some cases, the non-spill container will have a straw passing through a hole in the top of the container. These containers will inhibit spillage, but are not completely sealed, and they must be picked up quickly or they will spill.

SUMMARY OF THE INVENTION

The general object of the invention is to provide a drinking container that will not spill. The drinking container of the invention has a cylindrical side, a top, and a bottom. The top has two openings, which are normally closed by a pair of stoppers.

The stoppers are mounted on the distal ends of the arms of a Y-shaped spring. The leg of the spring extends through a hole in the side of the container.

A handle is connected to the side of the container, so that the handle can pivot about the lower end of the handle. The upper end of the handle is connected to the end of the leg of the spring. Therefore, when the handle is grasped, the handle pivots, and the leg of the spring is pulled through the hole in the container.

As the leg of the spring is pulled through the hole in the container, the arms of the spring are pulled through a restraint, which forces the arms together. This action moves the stoppers away from the openings in the top of the container.

The container of the invention also has a straw and a one-way valve, mounted in the top of the container. The valve allows air to enter the container, but will not allow liquid in the container to spill.

The above, as well as additional objects, features, and advantages of the invention will become apparent in the following detailed description.

DESCRIPTION OF THE PREFERRED EMBODIMENT

Figure 1:
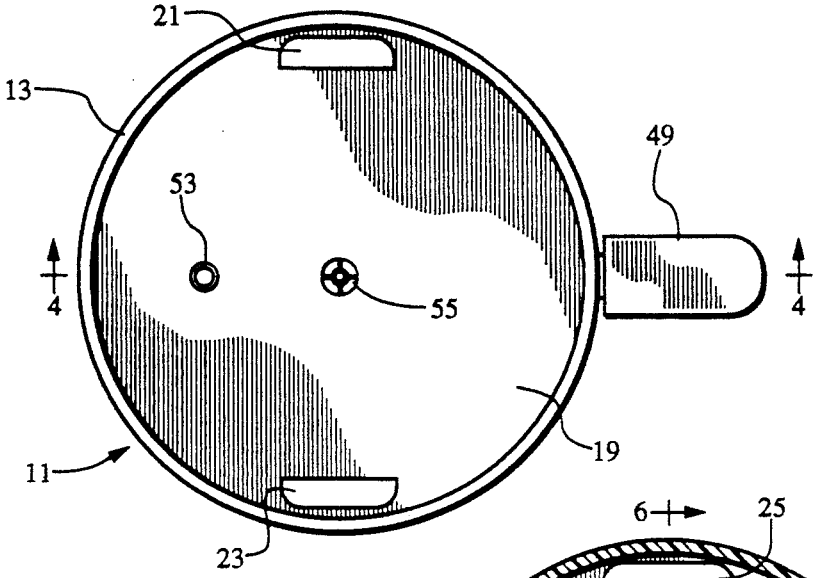
FIG. 1 is a top plan view of a container for liquids according to the invention.
Figure 2:
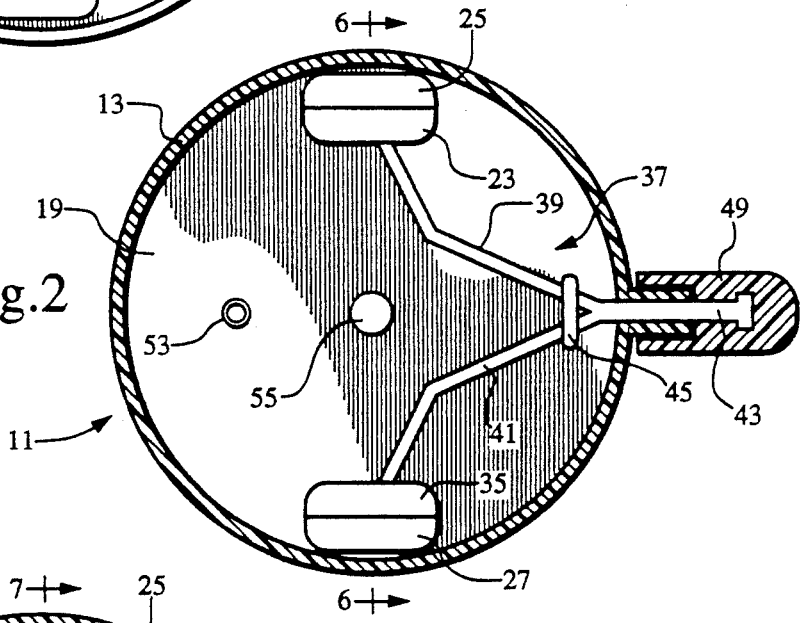
FIG. 2 is a sectional view of the container for liquids, as seen along lines 2—2 in FIG. 4.
Figure 3:
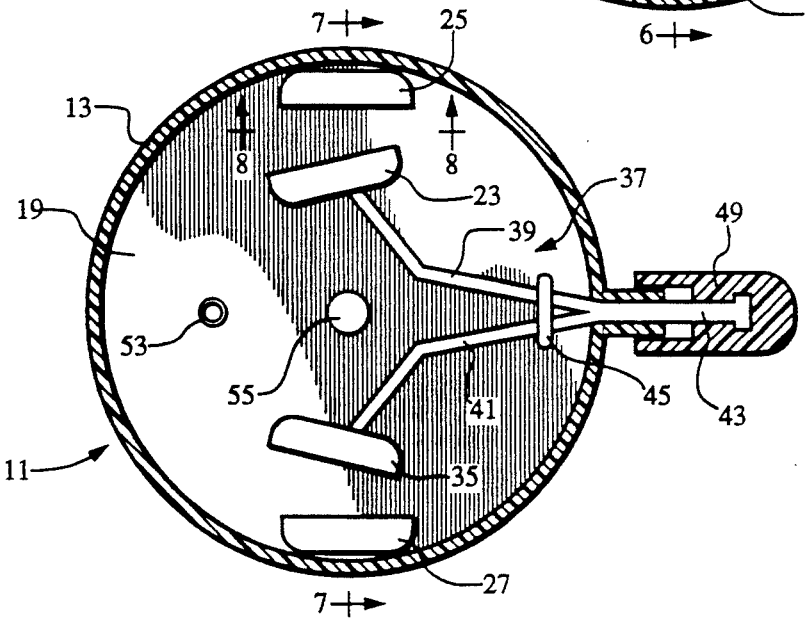
FIG. 3 is a sectional view of the container for liquids, as seen along lines 3—3 in FIG. 5.

The preferred embodiment of the container for liquids of the invention is a drinking cup 11 having a cylindrical outer side 13. A circular bottom 15 is connected to the lower end of the outer side 13 with threads 17. The drinking cup 11 also has an integral top 19 covering the upper end of the cup 11. Therefore, the drinking cup 11 forms a closed, hollow cylinder. The bottom 15 can be unscrewed in order to pour liquid into the cup 11.

The top 19 of the cup 11 has a pair of rectangular openings 21 and 23. These openings 21 and 23 are on opposite sides of the cup top 19, and allow for both right-handed and left-handed use of the cup 11.

Figure 6:
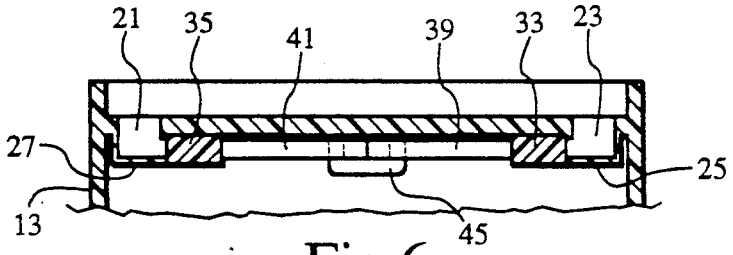
FIG. 6 is a sectional view of the container for liquids, as seen along lines 6—6 in FIG. 2.
Figure 8:
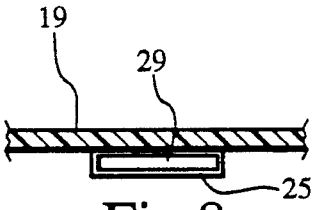
FIG. 8 is a sectional view of the container for liquids, as seen along lines 8—8 in FIG. 3.
Figure 7:
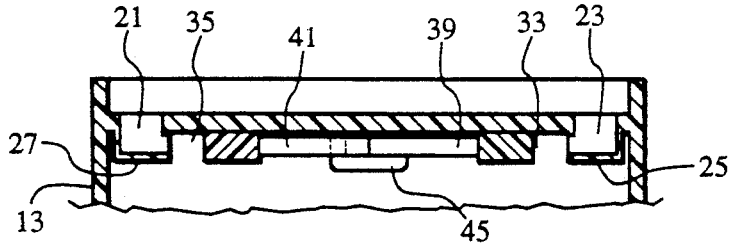
FIG. 7 is a sectional view of the container for liquids, as seen along lines 7—7 in FIG. 3.

As is best shown in FIG. 6, a pair of curved projections 25 and 27 are mounted on the lower side of the cup top 19, next to the openings 21 and 23. These projections 25 and 27 have vertical openings 29 and 31.

The vertical opening 29 and 31 are normally closed by a pair of stoppers 33 and 35. The stoppers 33 and 35 are rectangular and are made of a soft plastic. The stoppers 33 and 35 are mounted on a Y-shaped spring 37, which has two arms 39 and 41, and a leg 43. The stoppers 33 and 35 are mounted on the distal ends of the arms 39 and 41, and ordinarily the stoppers 33 and 35 are held against the vertical openings 29, to keep liquid from pouring out of the cup 11.

The Y-shaped spring 37 passes through a U-shaped restraint 45, which extends downward from the inner surface of the cup top 19. The leg 43 of the spring 37 then passes through a hole 47 in the side 13 of the cup 11.

Figure 5:
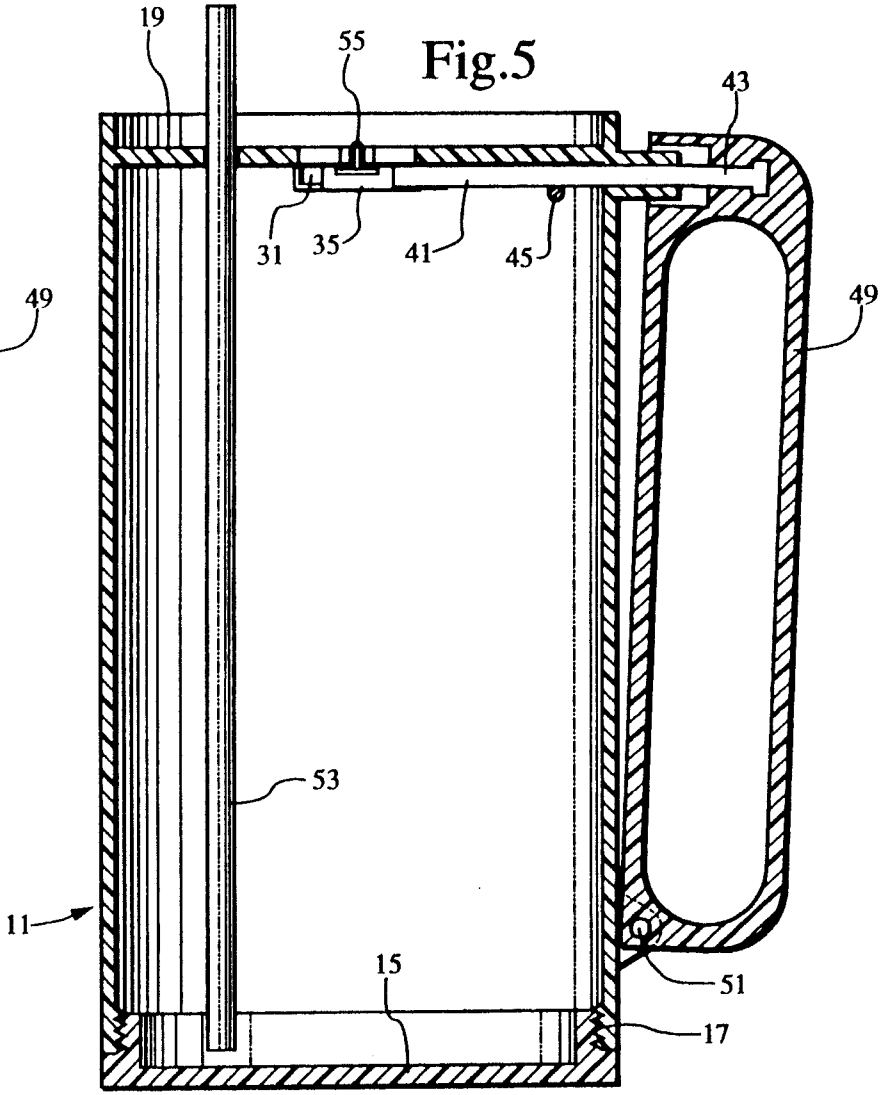
FIG. 5 is a sectional view of the container for liquids, as seen along lines 4—4 in FIG. 2, with the handle pivoted to the open position.
Figure 4:
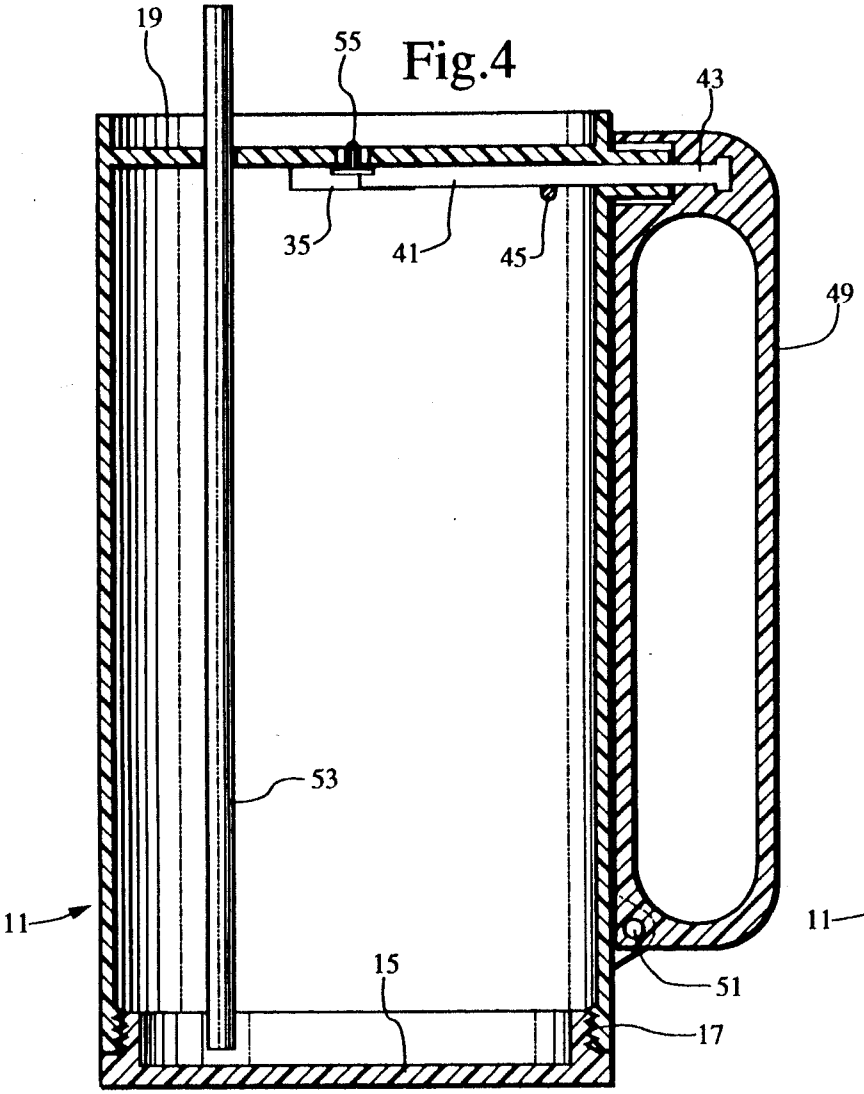
FIG. 4 is a sectional view of the container for liquids, as seen along lines 4—4 in FIG. 2.

A handle 49 is connected to the side 13 of the cup 11. The lower end of the handle 49 is mounted to the side 13 of the cup 11 with a pivot pin 51, so that the handle 49 can pivot about its lower end. The handle 49 can pivot between the positions shown in FIGS. 4 and 5.

The upper end of the handle 49 is connected to the leg 43 of the spring 37. When the handle 49 is pivoted, the leg 43 of the spring 37 is pulled outward through the hole in the side 13 of the cup 11. As the leg 49 is pulled through the hole in the side 13 of the cup 11, the arms 39 and 41 are pulled through the restraint 45. As the arms 39 and 41 move through the restraint 45, the arms 39 and 41 are pushed together. This action pulls the stoppers 33 and 35 away from the vertical openings 29 and 31, allowing liquid to be poured from the cup 11.

When the cup 11 is set down or dropped, the arms 39 and 41 tend to return to their original positions, and pull the leg 43 of the spring 37 inward through the hole in the side 13 of the cup 11. The arms 39 and 41 also force the stoppers 33 and 35 back against the vertical openings 29 and 31 to prevent liquid from flowing through the openings 29 and 31.

The drinking cup 11 of the invention also has a straw 53, which extends through a hole in the top 19 of the cup 11. The straw 53 fits tightly in the hole, so that liquid cannot flow through the hole around the sides of the straw 53.

A one-way valve 55 is mounted in the top 19 of the cup 11. The valve 55 allows air to enter the cup 11, but does not allow liquid to pour out of the cup 11. The valve 55 thus allows use of the straw 53, without letting liquid spill out of the cup 11.

The drinking container 11 of the invention has several advantages over the prior art. Normally, the cup 11 is closed, and liquid cannot spill out of the cup 11. However, when the cup 11 is raised by the handle 49, the stoppers 33 and 35 are moved away from the vertical openings 29 and 31, to allow liquid to pour through one of the openings 21 and 23. If the cup 11 is dropped or set down, the stoppers 33 and 35 automatically close the openings 21 and 23.

The invention has been described in only one embodiment. It should be apparent to those skilled in the art that the invention is not so limited, but is susceptible to various changes and modifications without departing from the spirit of the invention.

I claim:

1. A container for liquids, comprising:

an outer side;

a bottom connected to the outer side;

a top attached to the outer side and having an opening;

at least one stopper, movable between an open position, in which liquid can be poured out of the container through the opening, and a closed position, in which the at least one stopper prevents liquid from flowing through the opening;

a handle, having an upper end and a lower end;

a pivot pin for connecting the lower end of the handle to the side of the container; and connection means for connecting the handle to the at least one stopper for moving the at least one stopper to the open position when the container is picked up by the handle, and for moving the at least one stopper to the closed position when the handle is released.

2. A container for liquids as recited in claim 1, wherein the connection means comprises:

a spring, connected to the at least one stopper and extending through a hole in the side of the container and connected to the handle; and a restraint for forcing the spring in a particular direction when the spring is pulled through the hole in the container, so that the at least one stopper is moved to the open position.

3. A container for liquids as recited in claim 2, wherein the restraint is a U-shaped projection extending downward from the top of the container.

4. A container for liquids as recited in claim 2, wherein the bottom is removable to allow liquid to be poured into the container.

5. A container for liquids, comprising:

an outer side;

a bottom connected to the outer side;

a top attached to the outer side and having a pair of openings;

a pair of stoppers, movable between an open position, in which liquid can be poured out of the container through the openings, and a closed position, in which the stoppers prevent liquid from flowing through the openings;

a Y-shaped spring, having two arms and a leg, wherein the distal ends of the arms are connected to the stoppers and the leg extends through a hole in the side of the container;

a handle, having an upper end and a lower end, wherein the lower end of the handle is connected to the side of the container, so that the handle can pivot about the lower end of the handle, and wherein the upper end of the handle is connected to the leg of the Y-shaped spring, so that the leg is pulled through the hole in the container when the container is picked up by the handle; and a restraint for forcing the two arms of the spring toward one another when the leg of the spring is pulled through the hole in the container, so that the openings of the container are opened.

6. A container for liquids as recited in claim 5, wherein the restraint is a U-shaped projection extending downward from the top of the container.

7. A container for liquids as recited in claim 5, wherein the bottom is removable to allow liquid to be poured into the container.

8. A container for liquids, comprising:

an outer side;

a bottom attached to the outer side;

a top attached to the outer side;

a straw extending through a hole in the top;

a one-way valve, mounted in a hole in the top;

a pair of stoppers, movable between an open position, in which liquid can be poured out of the container through a pair of openings in the top, and a closed position, in which the stoppers prevent liquid from flowing through the openings;

a Y-shaped spring, having two arms and a leg, wherein the distal ends of the arms are connected to the stoppers and the leg extends through a hole in the side of the container;

a handle, having an upper end and a lower end, wherein the lower end of the handle is connected to the side of the container, so that the handle can pivot about the lower end of the handle, and wherein the upper end of the handle is connected to the leg of the Y-shaped spring, so that the leg is pulled through the hole in the container when the container is picked up by the handle; and a restraint for forcing the two arms of the spring toward one another when the leg of the spring is pulled through the hole in the container, so that the openings of the container are opened.

9. A container for liquids as recited in claim 8, wherein the restraint is a U-shaped projection extending downward from the top of the container.

10. A container for liquids as recited in claim 8, wherein the bottom is removable to allow liquid to be poured into the container.

* * * * *